United States Patent [19]

Simm et al.

[11] Patent Number: 5,014,915

[45] Date of Patent: May 14, 1991

[54] APPARATUS FOR THE FLAME SPRAYING OF POWDER MATERIALS BY MEANS OF AN AUTOGENOUS FLAME

[75] Inventors: Wolfgang Simm, Ecublens; Hans-Theo Steine, Cugy, both of Switzerland; Karl P. Streb, Markt-Mömbris, Fed. Rep. of Germany

[73] Assignee: Castolin S.A., St. Sulpice, Switzerland

[21] Appl. No.: 477,634

[22] Filed: Feb. 9, 1990

[30] Foreign Application Priority Data

Feb. 10, 1989 [DE] Fed. Rep. of Germany ..... 3903887

[51] Int. Cl.[5] ..... B05B 1/24; B05B 1/28; B05C 5/04

[52] U.S. Cl. ..... 239/79; 239/132.3; 239/290; 239/300; 219/76.16; 219/121.47

[58] Field of Search ..... 239/79, 81, 85, 132.3, 239/290, 300; 219/76.15, 76.16, 121.47

[56] References Cited

U.S. PATENT DOCUMENTS 4,125,754 11/1978 Wasserman et al. ..... 219/121.47
4,308,996 1/1982 Rotolico ..... 239/290
4,358,053 11/1982 Ingham et al. ..... 239/132.3 X
4,634,611 1/1987 Browning ..... 239/132.3 X
4,817,872 4/1989 Mattson ..... 239/300

*Primary Examiner*—Andres Kashnikow
*Assistant Examiner*—William Grant
*Attorney, Agent, or Firm*—Bachman & LaPointe

[57] ABSTRACT

An apparatus for the flame spraying of powder materials by means of an autogenous flame comprising a nozzle carrier which has a burner nozzle and which projects into a guide opening of a preferably tubular attachment body provided with coolant guide means surrounding the burner nozzle, in particular an attachment body which is provided with an accelerating tube, is to be improved in that the nozzle carrier (10) is surrounded by a nozzle means (30) for construction of the flame and the nozzle means has an outlet opening or openings for constricting gas, the opening or openings extending axially or radially relative to the burner nozzle (11). The constricting gas is supplied through an annular stabilization chamber (28). In an embodiment the stabilization chamber (28) is of variable and is provided with an annular discharge gap (34) as the outlet opening.

20 Claims, 2 Drawing Sheets

APPARATUS FOR THE FLAME SPRAYING OF POWDER MATERIALS BY MEANS OF AN AUTOGENOUS FLAME

BACKGROUND OF THE INVENTION

The invention relates to an apparatus and method for flame spraying powder materials by means of an autogenous flame comprising a nozzle carrier which has a burner nozzle and which projects into a guide opening of a preferably tubular attachment body which is provided with coolant guide means surrounding the burner nozzle.

In all known processes for high-energy flame spraying with an autogenous flame, which operate with constriction of the flame in a water-cooled accessory device, problems occur when using accelerating tubes of considerable length due to particles encountering the wall of the tube, such particles resulting in clogging of or damage to the accelerating accessory device, when the apparatus is in operation over a prolonged period. Those problems are to be attributed to the unfavourable turbulence effect in respect of the fine particles in the outer zone of the flame and are heavily dependent on the powder material or the composition, grain size, method of manufacture and morphology of the particles.

If a process which employs a water-cooled accelerating tube is to be used for coating purposes, the accelerating tube has to be designed specifically for each powder material. Hitherto it has not been possible to operate flame spray apparatuses with an accelerating accessory device over a prolonged period without encountering difficulties and disturbances.

The object of the invention is to eliminate those problems.

SUMMARY OF THE INVENTION

The foregoing object is attained by the present invention wherein a nozzle carrier is surrounded by a nozzle means for constriction of the flame, and the nozzle means has an outlet opening or openings for a constricting gas, such as argon, helium, nitrogen or compressed air, the opening or openings extending substantially axially or substantially radially relative to the burner nozzle.

In accordance with further features of the invention, the nozzle means includes at least one stabilisation chamber for the constricting gas which is fed to the apparatus. The stabilisation chamber, which in accordance with the invention is of constant or variable volume, surrounds the longitudinal axis of the apparatus in an annular configuration, and adjoins the outlet opening or openings.

The outlet openings are preferably either an annular array of bores which extend parallel to the axis of the apparatus, or in the form of an annular gap.

In accordance with the invention, an embodiment of the nozzle means with constant stabilisation chamber and the gas feed means therefor is releasably arranged on an accelerating tube and projects beyond same with a mouth tube.

In another embodiment of the nozzle means according to the invention, the nozzle means comprises a mouth tube which projects beyond the accelerating tube towards its end, and a nozzle tube which is connected to the attachment body and with same delimits the variable stabilisation chamber. In this construction the gas feed means of the stabilisation chamber is to be disposed in the attachment body.

The stabilisation chamber may be delimited at one end by an internal collar of the nozzle means, the collar forming a gap with the accelerating tube, while the internal collar preferably terminates in the form of a knife edge.

Besides the use of nozzle bodies which are separable from the attachment body, it is also possible for the attachment body to be in one piece with the nozzle means and to be provided both with the coolant guide means and with the stabilisation chamber.

In accordance with the invention the constricting gas pressure is built up and stabilised in the stabilisation chamber behind the outlet opening. Upon displacement of the nozzle means on the water-cooled accelerating tube, a second constriction of the flame is effected by the flow of gas in the range between 20 and 100 mm, preferably 30 and 80 mm.

If the water-cooled accelerating tube is kept relatively short, a second constricting nozzle is fitted on to same and the flame is further constricted and accelerated by a gas flow, at the same speed as that of the flame.

A range between 30 and 150 mm, preferably 30 and 80 mm, has proven to be an ideal length for the accelerating tube.

The zone of deposits in the water-cooled accelerating tube is thereby displaced into the region of the gas constriction effect which is at between 20 and 100 mm and preferably from 30 to 80 mm from the discharge of the flame from the water-cooled accelerating tube.

The problem of the fine particles adhering to the wall of the tube is also overcome by virtue of the flow of gas which issues from the constricting gas nozzle.

The total cross-section in respect of the gas outlet opening in accordance with the invention should be between 0.1 and 30 $mm^2$, preferably between 1 and 10 $mm^2$, and ideally from 2 to 8 $mm^2$.

In the case of outlet openings of an annular gap configuration, gap widths of between 0.01 and 1.0 mm, preferably between 0.05 and 0.7 mm, have proven to be desirable.

In accordance with the invention the constricting gas nozzle may also be fitted on to the nozzle carrier of a flame spray apparatus without the water-cooled accelerating accessory device, if the flame, depending on the powder material, is only to be accelerated to a speed in the range of from 150 to 250 m/s.

BRIEF DESCRIPTION OF THE DRAWINGS

Further advantages, features and details of the invention will be apparent from the following description of preferred embodiments and with reference to the drawings which are views in longitudinal section and in which.

DETAILED DESCRIPTION

Figure 1:
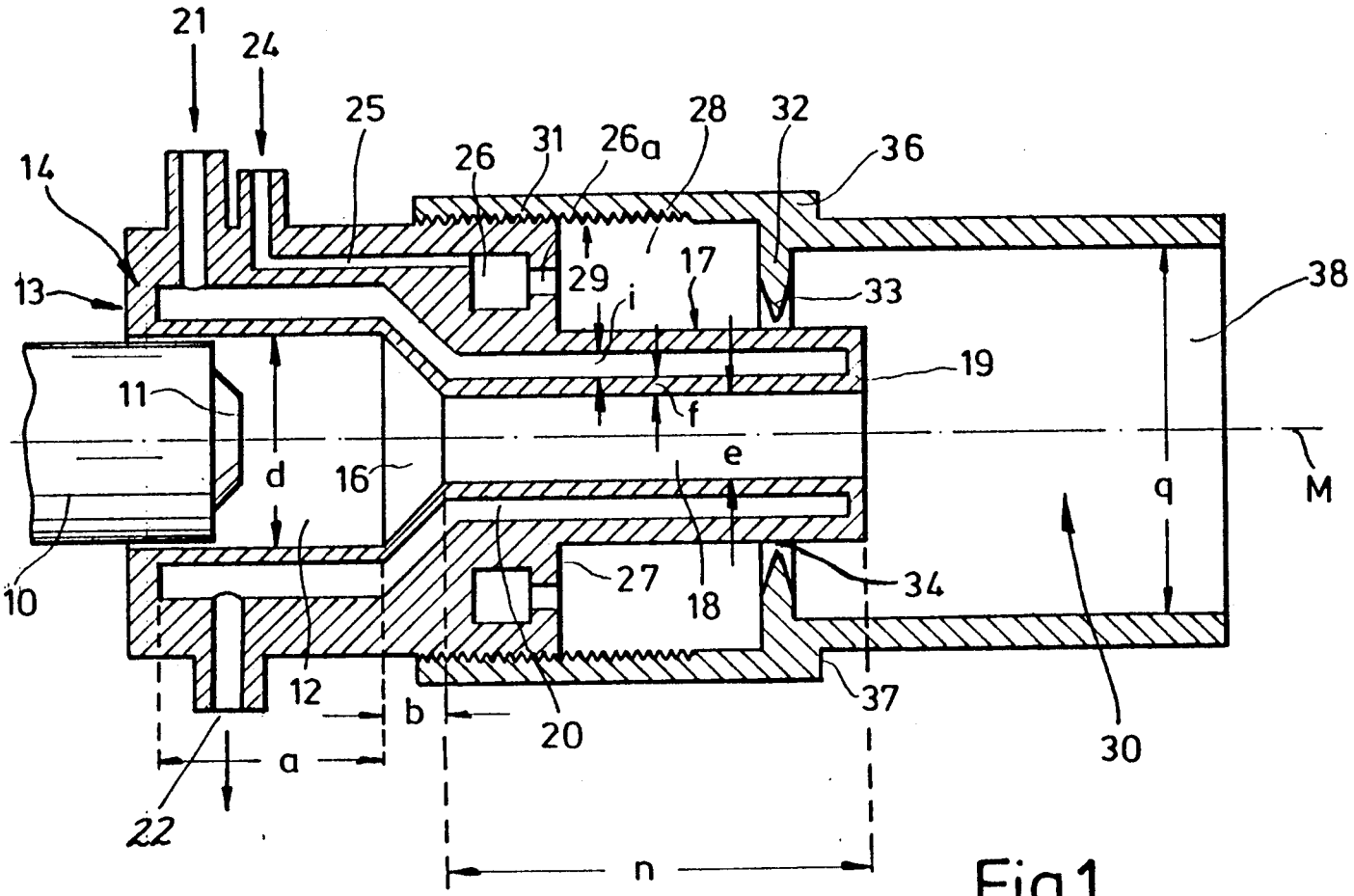
FIG. 1 shows a part of a burner with a nozzle carrier of a combustion chamber, a water-cooled accelerating tube and a gas constricting tube.

A nozzle carrier 10 of a burner (not shown in the drawing for the sake of clarity) projects with a burner nozzle 11 into a combustion chamber 12 of a diameter d, in such a way that the nozzle carrier 10 can be varied in position axially by a dimension indicated by a on the drawings.

The combustion chamber 12 is disposed in a tubular body 14 in the form of an accelerating accessory device and tapers in region 16 of length b to provide an axial passage 18 of diameter e of a water-cooled accelerating tube 19. In this case the length n of the accelerating tube 19 is 60 mm. The axial passage 18, as well as the conical region 16 and the combustion chamber 12, are surrounded at a spacing f by an annular space 20 acting as a cooling passage having a width i.

In the region of the end portion 13 of the tubular body 14, which projects towards the burner, an intake connection 21 and a discharge connection 22 for cooling water extend radially from the cooling passage 20. Disposed beside the intake connection 21 is a further pipe connection 24 for receiving a constricting gas, which is extended in the tubular body 14 in the form of a narrow gas passage 25 to an annular passage 26 for constricting gas.

The annular passage 26 is communicated by way of bores **26*a* with a stabilisation chamber 28 for a variable gas pressure. The stabilisation chamber 28 is delimited on the one hand radially by the peripheral surface 17 of the accelerating tube 19 and an internal surface 29 of a gas constricting tube 30 with female screwthread 31, and on the other hand in the axial direction by a shoulder surface 27 of the annular body 14 and an oppositely disposed internal collar 32 on the gas constricting tube 30. The gas constricting tube 30 is screwed on to the circumference of the tubular body 14 at 31 and engages over the shoulder surface 27 provided by the accelerating tube 19. The internal collar 32 is in the form of a radial knife edge 33, towards the accelerating tube 19, and defines an annular gap or aperture 34** for the discharge of constricting gas.

The gas constricting tube 30 comprises a constricting gas nozzle 36 which has the above-mentioned screwthread 31, and a mouth tube 38 of smaller diameter; in the region of the internal collar 32 the gas constricting tube 30 in turn has a step 37.

The constricting gas, namely air, nitrogen or a noble gas such as argon or helium, is fed to the annular passage 26 by way of the pipe connection 21 and the gas passage 25. The constricting gas flows out of the annular passage 26 by way of a plurality of bores **26*a* into the variable-volume gas pressure stabilisation chamber 28 where the pressure is equalised out. The constricting gas flows at high speed into the gas constricting tube 30 by way of the knife-like edge 33 and the annular gap or aperture 34** and further constricts the flame in such a way that fine particles are prevented from adhering to the wall of the tube. The speed of discharge of the constricting gas should correspond to that of the flame.

The ignited flame burns in the combustion chamber 12 and is then constricted and accelerated in the water-cooled accelerating tube 19.

Figure 2:
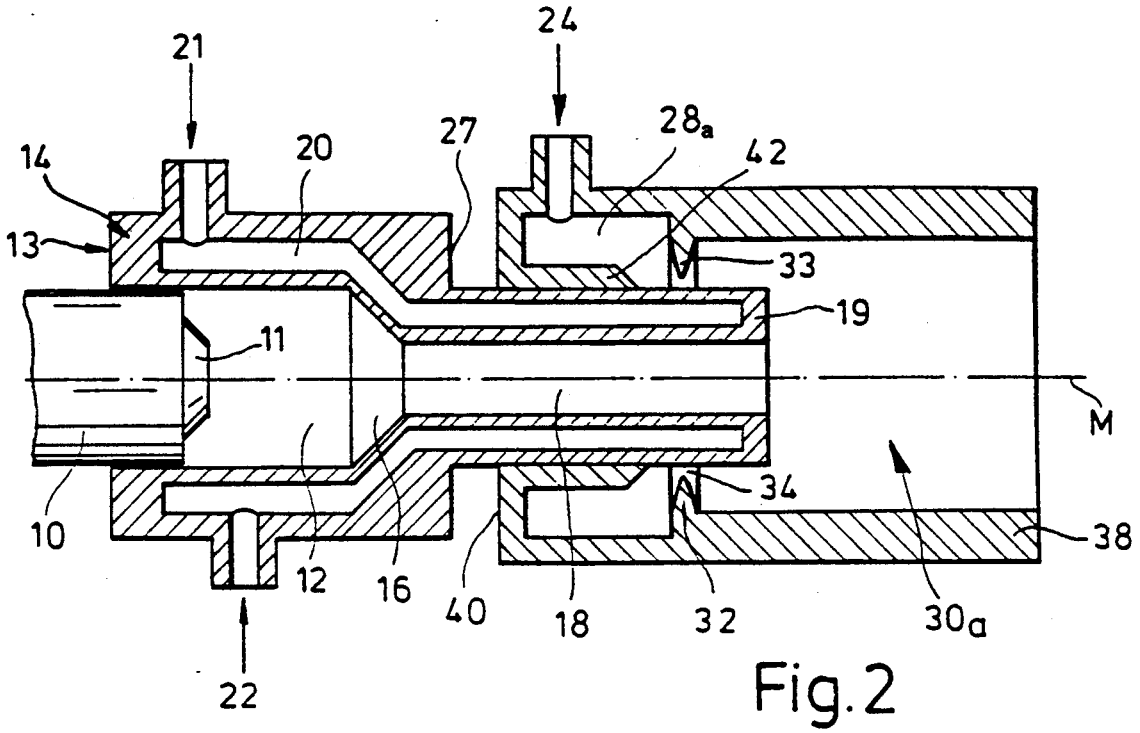
FIG. 2 shows an embodiment which is modified in relation to the FIG. 1 structure.

In the construction shown in FIG. 2, the tubular body 14 and the gas constricting tube **30*a* are separated at mutually oppositely disposed end faces 27 and 40; the gas constricting tube 30*a* is mounted displaceably on the accelerating tube 19 by means of an internal ring 42 which extends from the end face 40. In this embodiment, the stabilisation chamber 28*a* which is of constant volume is delimited by the internal ring 42 at the side of the stabilisation chamber which is directed towards the longitudinal axis M. The pipe connection 24 for the constricting gas projects from the gas constricting tube 30*a***.

Figure 3:
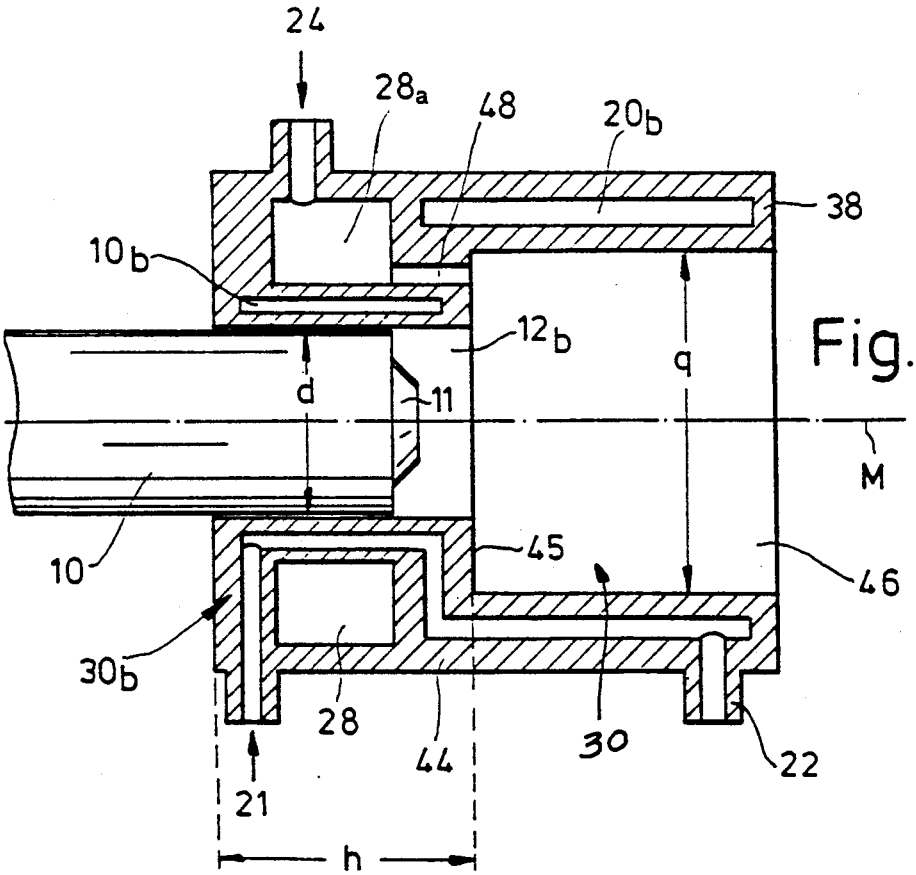
FIG. 3 shows another embodiment of the nozzle carrier with gas constricting tube carried directly thereon.

In FIG. 3 the nozzle carrier 10 is surrounded by a water-cooled constricting gas nozzle **30*b*, without an accelerating accessory device, on a tubular body 44 with an axial guide opening 12*b* of a length h for the nozzle carrier 10 and an adjoining tubular chamber 46** of larger diameter as indicated at q.

Disposed around the chamber 46 is an annular space, which is stepped at a radial surface 45, acting as a cooling passage **20*b* with intake and discharge connections 21 and 22. The above-described stabilisation chamber 28*a* is disposed around the guide opening 46 and opens with outlet bores 48 in the radial surface 45. The cross-section selected for the outlet bores 48** is from about 0.1 to 30 $mm^2$.

Discharge of the constricting gas into the gas constricting tube 30 occurs through the outlet bores 48 which are arranged in an annular array around the flame, and constriction of the gas is effected by expansion of the constricting gas after issuing from the outlet bores 48.

In an embodiment which is not illustrated, the outlet bores 48 are directed radially, for example into the guide opening 46.

It is understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. An apparatus for flame spraying powder materials comprising a combustion chamber, a burner nozzle positioned in said combustion chamber for producing a flame, and means downstream of said combustion chamber for receiving and constricting the flame said means for constricting includes nozzle means, a gas source and passageway means for communicating said gas source with said nozzle means, and adjusting means for axially adjusting the position of said burner nozzle and said nozzle means relative to each other.

2. An apparatus according to claim 1 wherein said nozzle means is elongated about a longitudinal axis and said passageway means includes an annular aperture disposed about said longitudinal axis for feeding gas from said gas source into said nozzle means for constricting the flame.

3. An apparatus according to claim 2 wherein an accelerating tube is positioned downstream of said combustion chamber between said combustion chamber and said nozzle means for receiving and accelerating the flame.

4. An apparatus according to claim 3 wherein said accelerating tube is formed in an attachment body and said nozzle means includes means for positioning said nozzle means on said attachment body.

5. An apparatus according to claim 4 wherein said attachment body and said nozzle means defines therebetween a pressure stabilization chamber of variable volume upstream of said annular aperture.

6. An apparatus according to claim 5 wherein said passageway means is formed in said attachment body.

7. An apparatus according to claim 5 wherein said means for positioning said nozzle means on said attachment body adjusts the volume of said pressure stabilization chamber and the length of said nozzle means.

8. An apparatus according to claim 3 wherein at least a portion of said accelerating tube is positioned within said nozzle means and defines therewith said annular aperture.

9. An apparatus according to claim 8 wherein an internal collar terminates in a knife edge adjacent said accelerating tube and defines therewith said annular aperture.

10. An apparatus according to claim 2 wherein said passageway means further includes at least one pressure stabilization chamber between said gas source and said annular aperture.

11. An apparatus according to claim 10 wherein said at least one pressure stabilization chamber is disposed about said longitudinal axis in an annular configuration.

12. An apparatus according to claim 10 including means for varying the volume of said at least one pressure stabilization chamber.

13. An apparatus according to claim 10 wherein said nozzle means is releasably secured to an accelerating tube and said at least one pressure stabilization chamber is formed in said nozzle means.

14. An apparatus according to claim 2 wherein said annular aperture comprises a plurality of annularly arrayed bores which extend substantially parallel to said longitudinal axis.

15. An apparatus according to claim 14 wherein the total area of said bores is between 0.1 and 30 $mm^2$.

16. An apparatus according to claim 14 wherein the total area of said bores is between 1 and 10 $mm^2$.

17. An apparatus according to claim 14 wherein the total area of said bores is between 2 and 8 $mm^2$.

18. An apparatus according to claim 14 wherein the annular aperture has a gap of between 0.01 to 1.0 mm.

19. An apparatus according to claim 14 wherein the annular aperture has a gap of between 0.05 to 0.7 mm.

20. An apparatus according to claim 2 wherein said annular aperture is formed in a flange defined by the junction of said combustion chamber and said nozzle means.

* * * * *